US005671575A

United States Patent [19]

Wu

[11] Patent Number: 5,671,575

[45] Date of Patent: Sep. 30, 1997

[54] FLOORING ASSEMBLY

[76] Inventor: Chang-Pen Wu, 5/F-2, No. 35, An-Shun 4th St., Pei-Tun Dist., Taichung City, Taiwan

[21] Appl. No.: 735,399

[22] Filed: Oct. 21, 1996

[51] Int. Cl.[6] ..... E04F 15/22

[52] U.S. Cl. ..... 52/403.1; 52/480

[58] Field of Search ..... 52/480, 403.1

[56] References Cited

U.S. PATENT DOCUMENTS

| | | | |
|---|---|---|---|
| 1,864,774 | 6/1932 | Storm | 52/403.1 |
| 3,518,800 | 7/1970 | Tank | 52/480 |
| 4,449,342 | 5/1984 | Abendroth | 52/480 X |
| 4,694,627 | 9/1987 | Omholt | 52/403.1 X |
| 4,945,697 | 8/1990 | Ott et al. | 52/480 X |
| 5,253,464 | 10/1993 | Nilsen | 52/480 X |
| 5,365,710 | 11/1994 | Randjelovic | 52/480 |

FOREIGN PATENT DOCUMENTS

| | | | |
|---|---|---|---|
| 455616 | 11/1991 | European Pat. Off. | 52/480 |

*Primary Examiner*—Carl D. Friedman
*Assistant Examiner*—Aimee E. McTigue
*Attorney, Agent, or Firm*—Morton J. Rosenberg; David I. Klein

[57] ABSTRACT

An improved flooring assembly includes a determined number of foundation elements, flooring elements, decorative strip seats and decorative strips. The foundation elements are provided with side and vertical grooves as well as vertical strips. The front sides are provided with face blocks, face grooves and auxiliary grooves. The flooring elements facing the foundation elements are provided with corresponding face grooves, face blocks and auxiliary blocks. The sides thereof are provided with positioning grooves and blocks. The foundation elements may be joined in a transverse or longitudinal manner to cover the floor area. The flooring elements are laid on the foundation elements. The decorative strip seats together with the decorative strips are fitted to the periphery.

5 Claims, 10 Drawing Sheets

FLOORING ASSEMBLY

BACKGROUND OF THE INVENTION (a) Field of the Invention

The present invention relates generally to an improved floor structure, and more particularly to an improved floor assembly structure to facilitate and speed up flooring. The floor may be taken up and reassembled like furniture assemblies.

(b) Description of the Prior Art

It is well known in the art that it is necessary to form a foundation on the floor surface before installing a wooden or bamboo floor. The foundation is formed by square strips of wood. Plywood has also be nailed to the foundation before the laying of the floor material. There are the following disadvantages with the prior art:

1. It requires various flooring steps, which is complicated and time-consumptive. It generates noise and considerable waste materials.
2. It requires professional workers. Besides, it is very costly since it requires considerable flooring materials and the process is slow.
3. The floor material cannot be taken up during removal since it is permanently stuck to the floor surface, which is a waste of timber material.
4. The foundation must be nailed to the floor surface. If it is to be removed, it will damage the integrity of the floor surface.
5. If the wood material is not good, the floor thus laid will not be even and requires replacement by professional workers, which is again costly and troublesome.

SUMMARY OF THE INVENTION

Accordingly, a primary object of the present invention is to provide a floor assembly to eliminate the drawbacks with the prior art.

In order to achieve the above-mentioned object, a plastic foundation is used to save natural timber material, provide better protective against dampness and reduce noise. The foundation is not nailed to the floor surface to save labor and prevent damage to the floor. The foundation and the floor material may be easily engaged to provide speedy and easy assembly. The foundation may be extended to both sides and prolonged longitudinally. The foundation is provided with decorative strips for urging against wall surfaces and positioning the floor material. It may be assembled or dismantled easily without the help of professional workers and may be re-used. Since it may be dismantled easily, it may be stored or removed to other places with ease. The floor surface may be increased or decreased at will depending on the number of accessories used. If some of the floor material is damaged or deformed, it may be replaced with ease. The user may design and achieve the desired floor patterns (of different colors and geometric shapes).

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
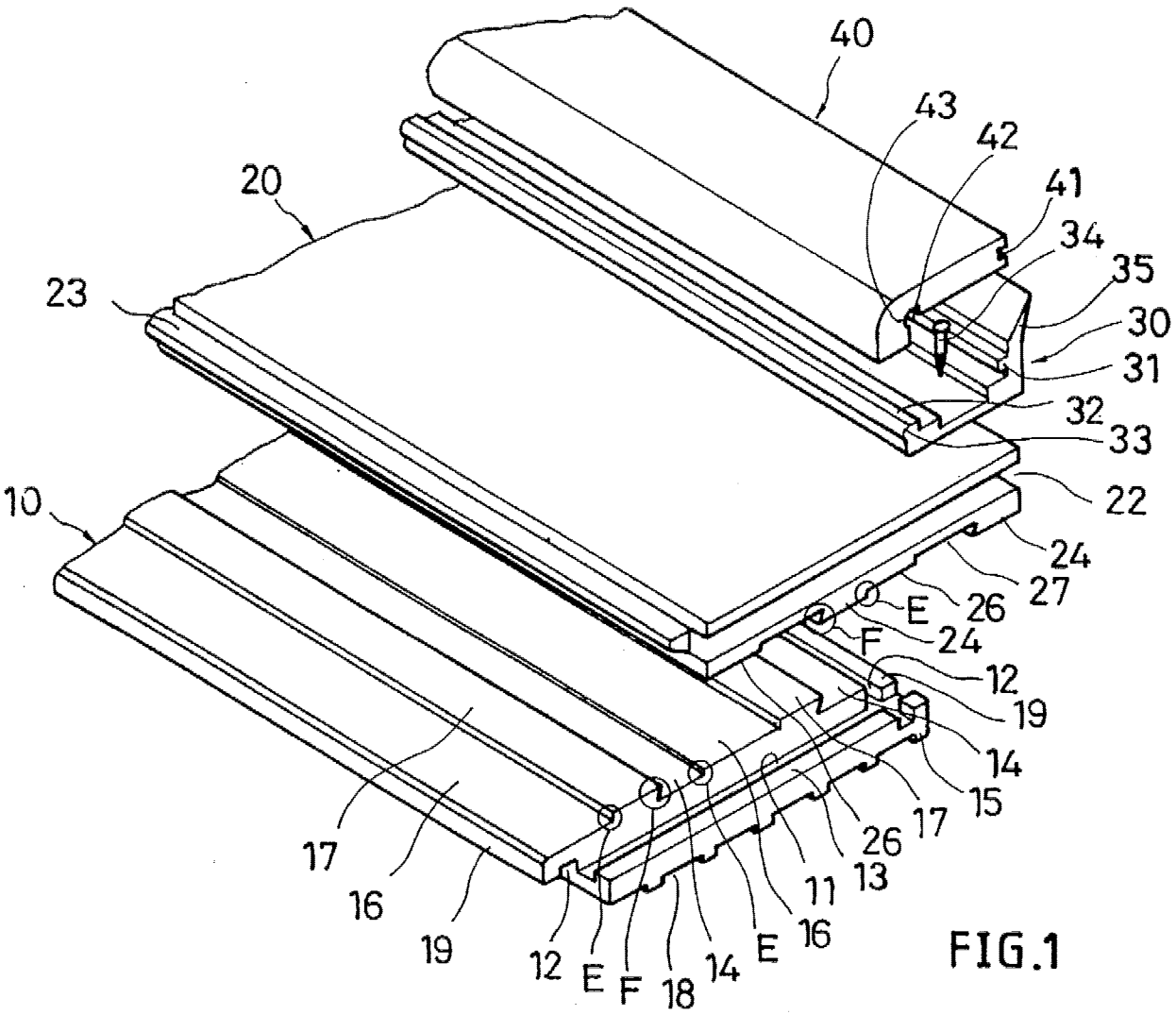
FIG. 1 is a schematic elevational view of the components of the invention.
Figure 2A:
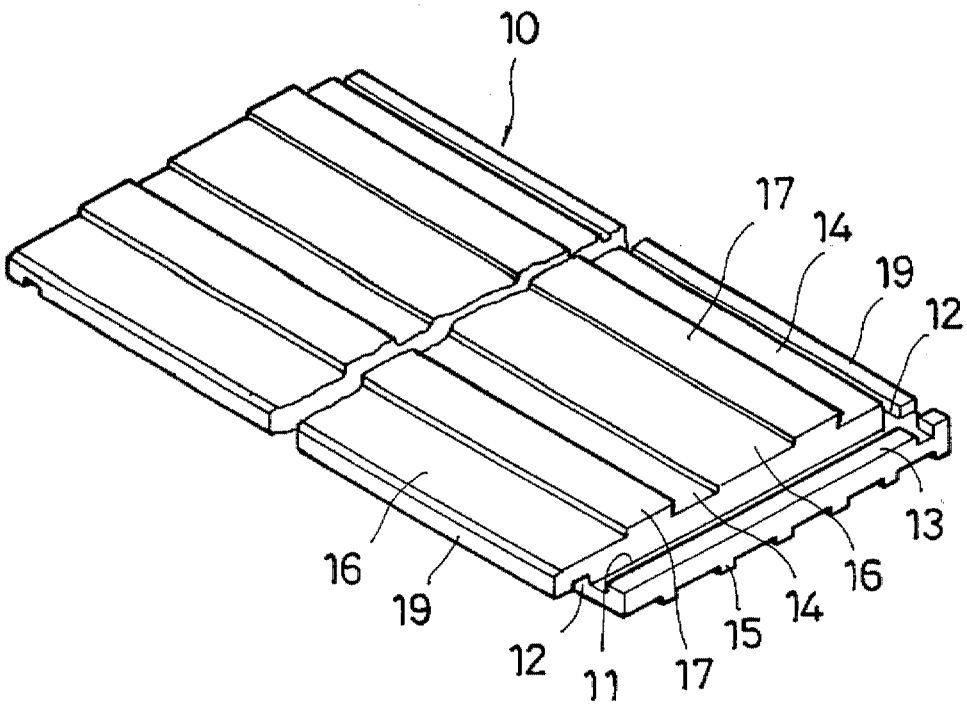
FIG. 2A is a bottom view of the foundation element of the invention.
Figure 2B:
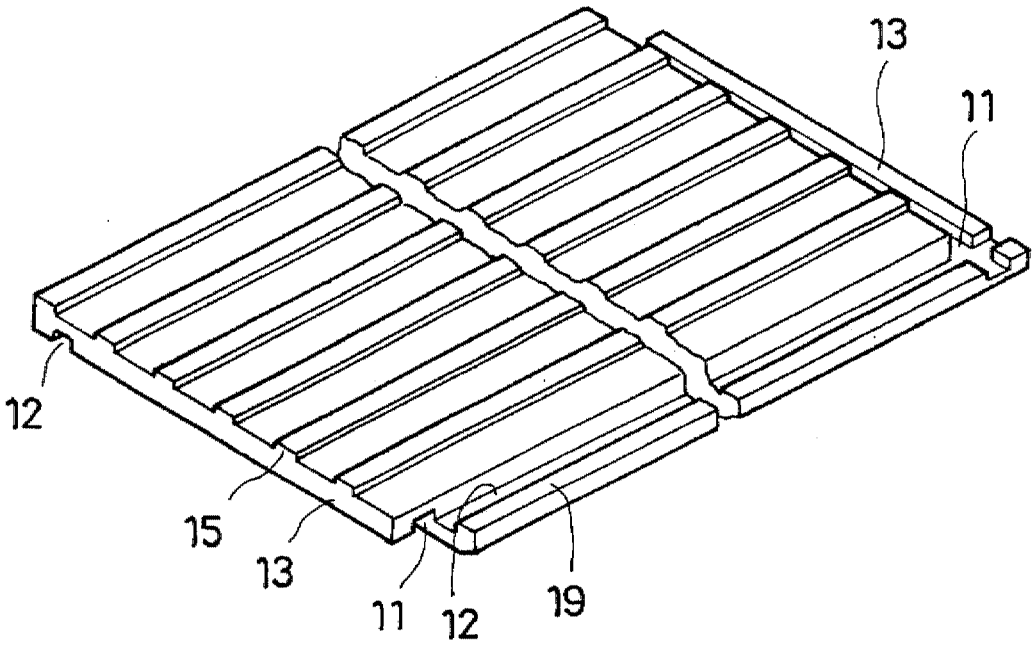
FIG. 2B is a top view of the foundation element of the invention.
Figure 3A:
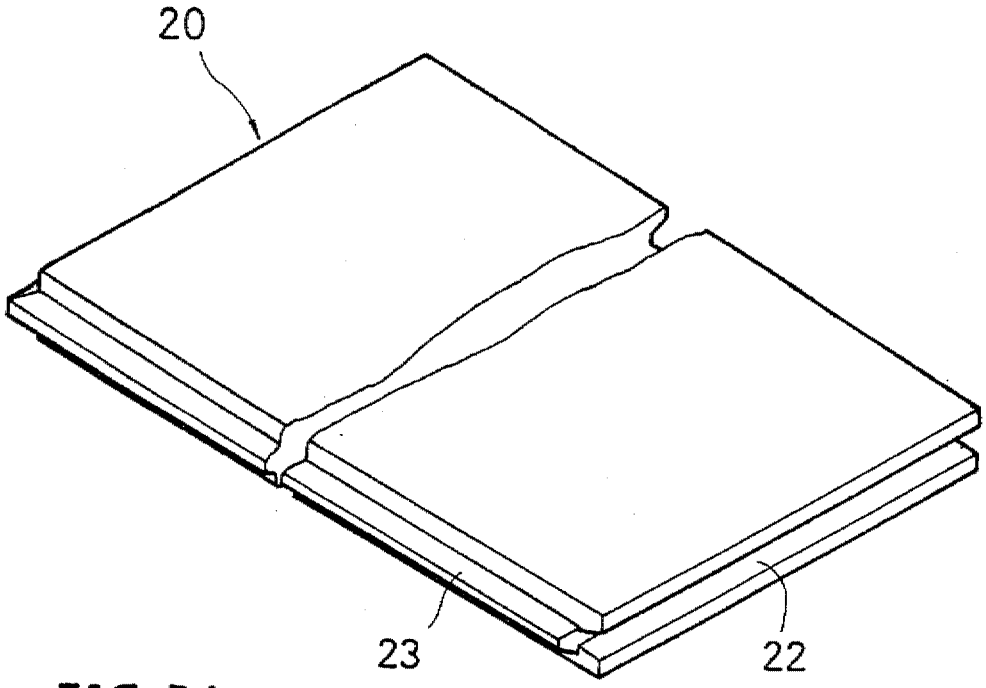
FIG. 3A is a bottom view of the flooring element of the invention.
Figure 3B:
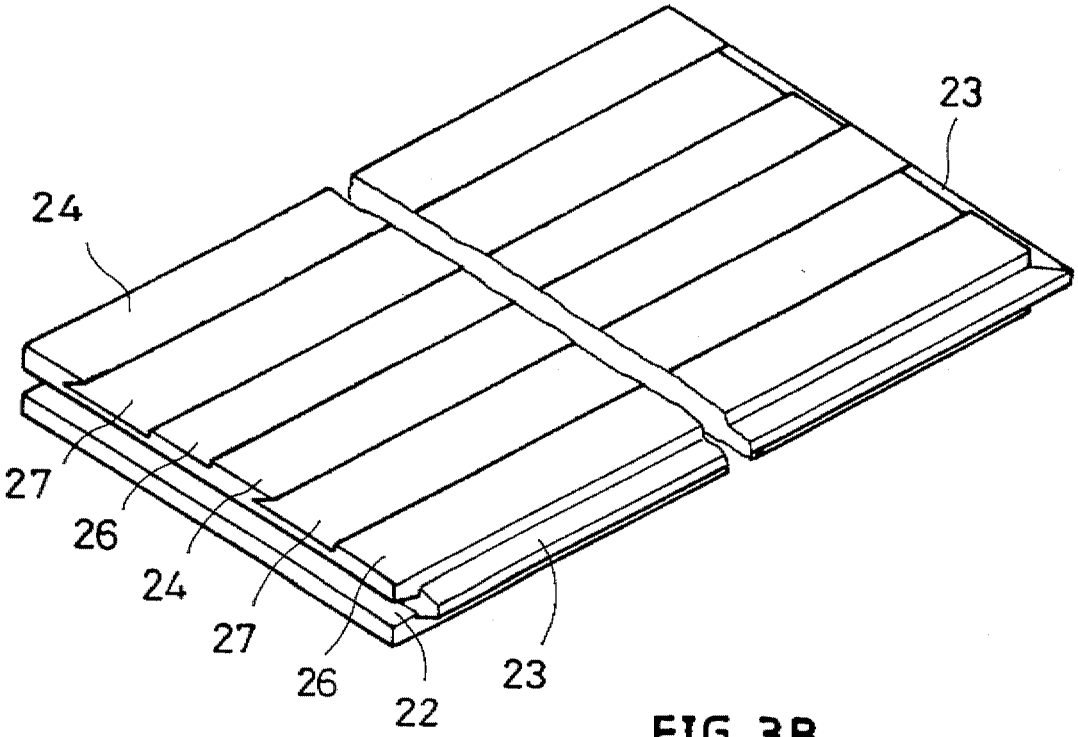
FIG. 3B is an elevational top view of the flooring element of the invention.

With reference to FIGS. 1–3, the present invention comprises a required number of foundation elements 10, flooring element 20, decorative strip strip seats 30 and decorative strips 40. Each component is pre-cut into the required length and width. The front side of the foundation elements and the rear side of the floor elements 20 are provided with corresponding grooves 14 and 27 and face projections 17 and 24.

The invention is characterized in that at the joint between the face groove 14 and the face projection 17 of the foundation element 10, one side is provided a vertical surface E, and the other side is an inclined surface F. Slightly raised auxiliary grooves 16 are also provided. The bottom side is distributed with non-skip strips 15 to form clearances 18 for blocking dampness. At one side of its front face is provided a linear groove 11 and a side groove 12 to form a linear strip 13 and a side strip 19. On the reverse side, there are also provided a linear groove 11 and a side groove 12 to form a linear strip 13 and a side strip 19. In this way, by means of the inter-engagement of the linear grooves and strips as well as the side grooves and strips, the flooring surface may be expanded to both sides as well as to the front and the back.

The joint between face groove 27 and face projection 24 at the bottom side of the floor element 20 is configured to be a vertical surface E at one side and an inclined surface F at the other side. Slightly depressed auxiliary blocks 26 are also provided. The periphery is provided with corresponding positioning grooves 22 and positioning projections 23 so that different floor elements may be joined by means of the positioning grooves and the projections to expand the flooring surface to both sides as well as to the front and the back.

The decorative strip seat 30 is substantially L-shaped for matching tap screws 34 to secure to the rims of the floor element 20. One side thereof is provided with a vertically oriented projected strip 32 while the other side thereof is provided with a horizontally oriented projected strip 31 and an inclined elastic piece 35. The vertical projected strip 32 is provided with a curved flange 33 at an outer side thereof.

The above-mentioned components and structure of the invention as well as its use and effects are discussed in more detail hereinbelow.

With references to FIGS. 4–7, the foundation elements 10 are laid according to the floor area of a room. The connection between foundation elements 10 is achieved by interengaging the downwardly orienting side groove 12 and side strip 19 of one foundation element 10 with the upwardly extending side groove 12 and side strip 19 of the other one. The foundation elements 10 may thus be connected one by one to cover the horizontal section. In extending the flooring area in a linear way, the linear groove 11 and linear strip 13 are interengaged in the above-described manner with horizontal extension. The foundation elements 10 spread all over the entire room surface until they urge against the wall. Certainly, the foundation elements 10 may be cut to fit the area of the room if necessary.

Figure 4:
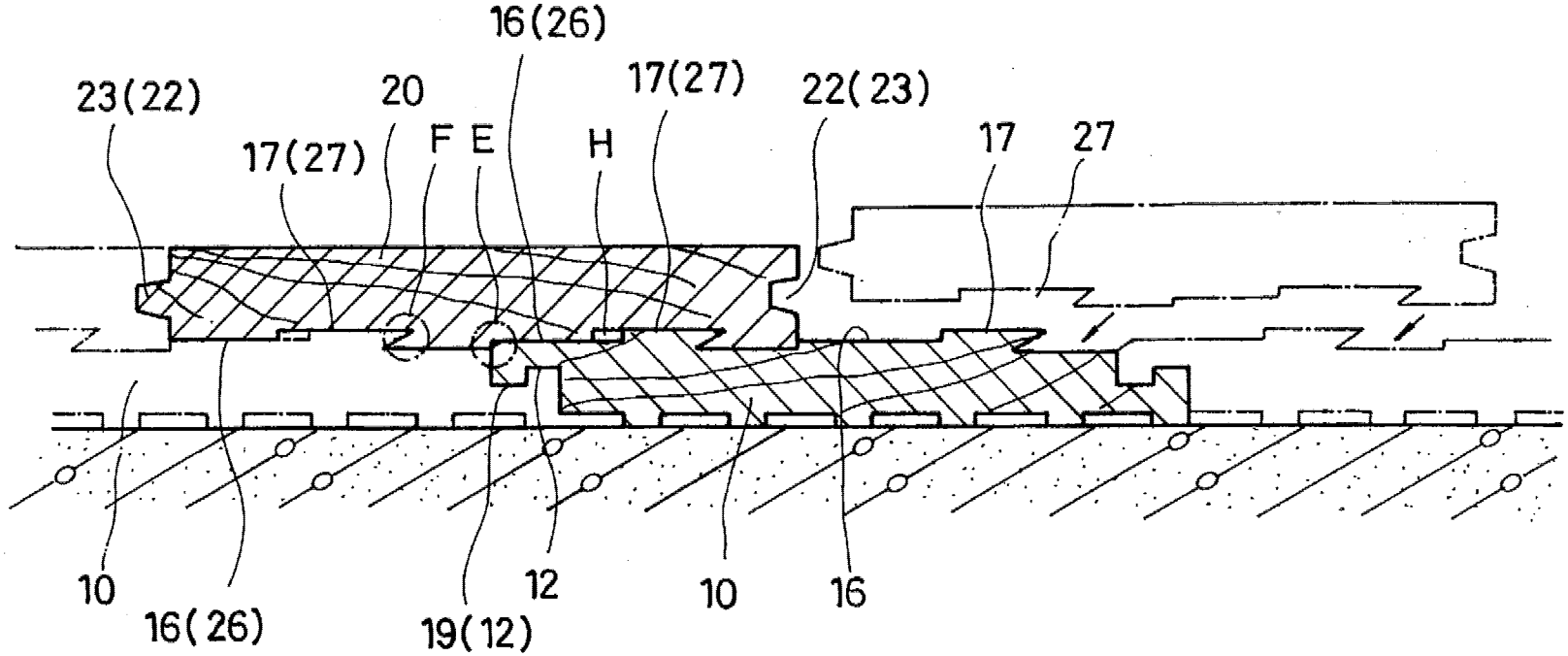
FIG. 4 is a schematic view showing assembly of the foundation element and the flooring element.
Figure 5:
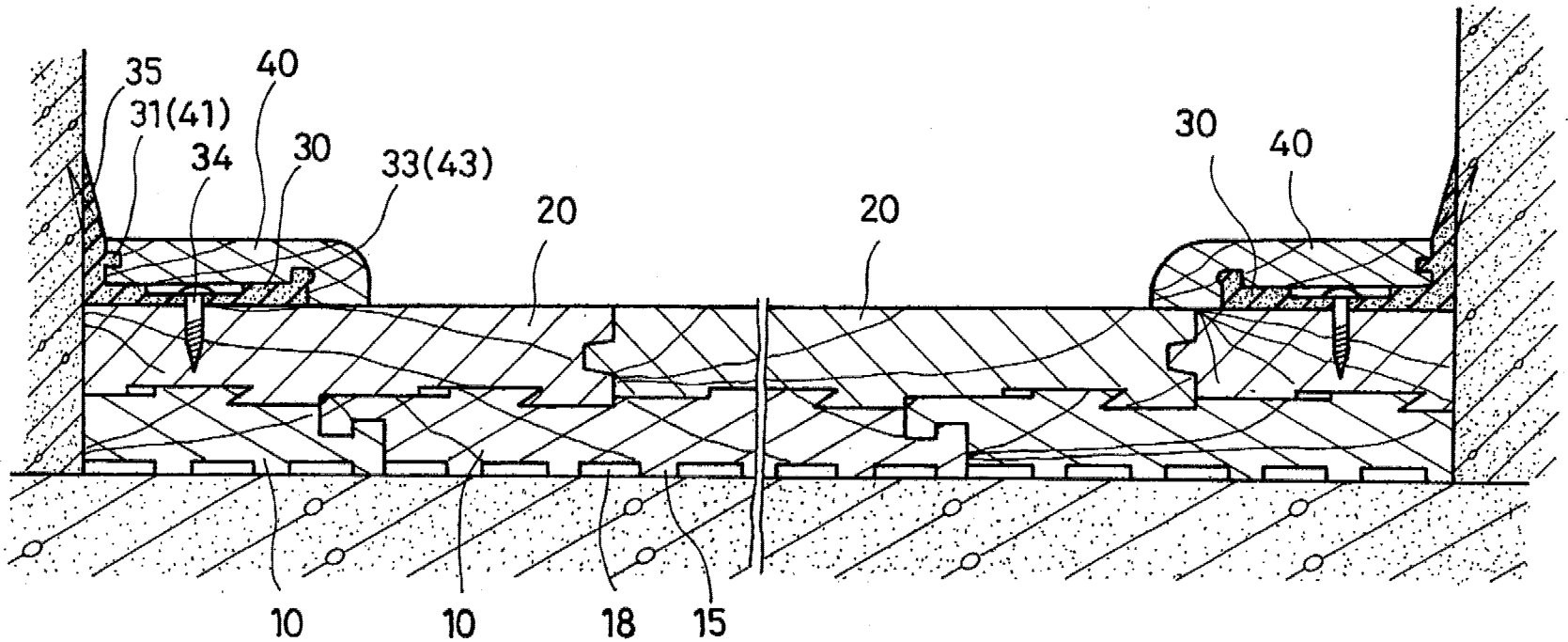
FIG. 5 is a sectional view of the invention after assembly.
Figure 6:
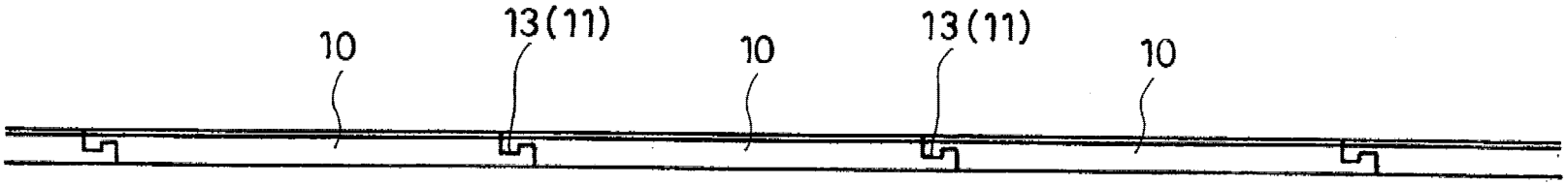
FIG. 6 is a schematic view illustrating linear extension of the foundation elements.
Figure 7:
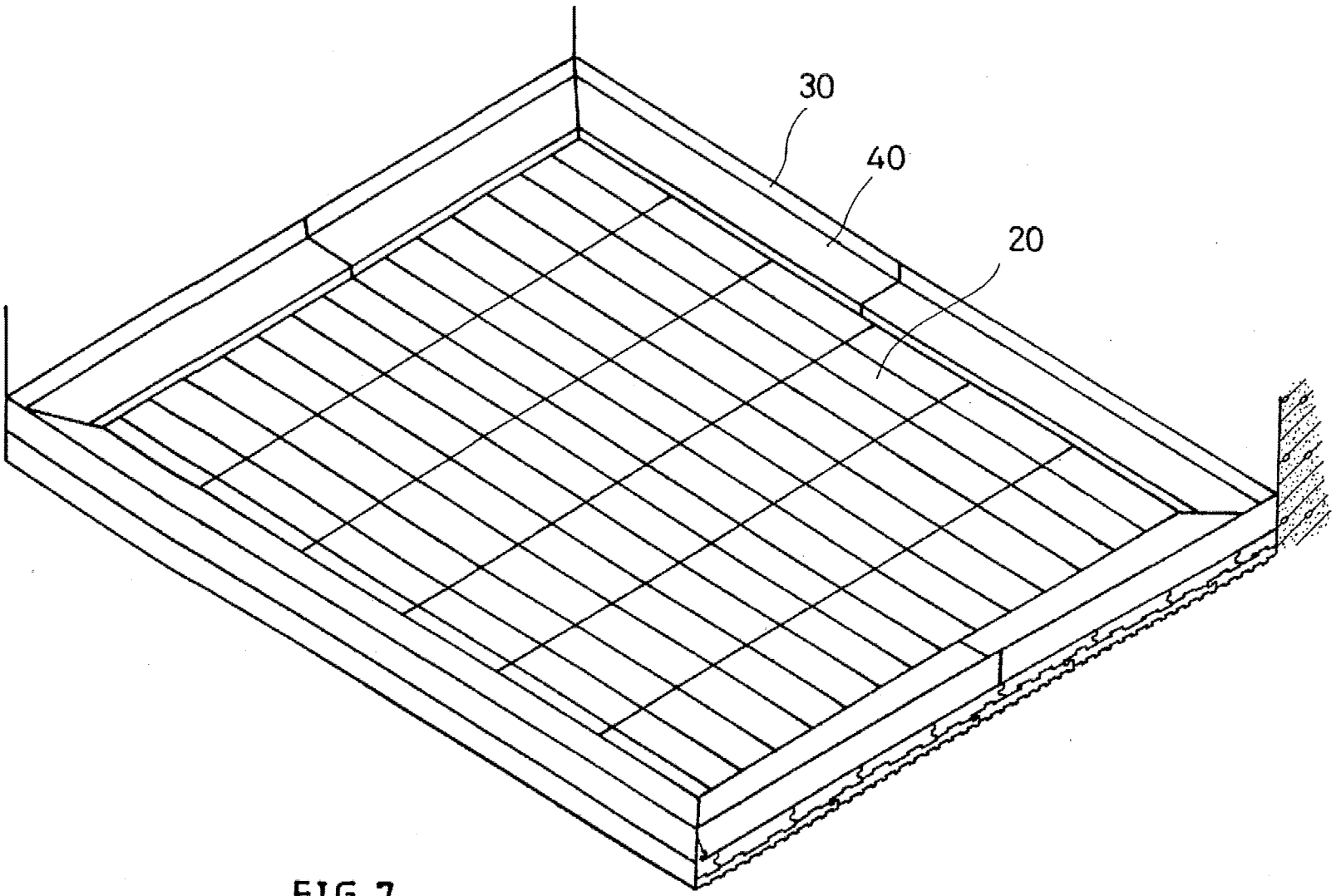
FIG. 7 is a schematic view of the flooring assembly of the invention used to cover the entire floor of a room.

Next, the face groove 27, the face projection 24 and the auxiliary block 26 at the bottom side of each of the flooring elements 20 are forced into the sides of the foundation elements 10 so that the positioning groove 22 and positioning block 23 of each flooring element 20 are connected in a mortise manner. The flooring elements 20 may thus be joined to the foundation elements 10 as a whole. It should be noted that the present invention has taken into consideration easy assembly and positioning of the flooring assembly. The meritorious features thereof include:

1. Easy assembly:

Referring to FIGS. 1 and 4, the present invention is provided with auxiliary grooves 16 and auxiliary blocks 26 that are slightly lower than the face projections 17 and 24 and are slightly higher than the face grooves 14 and 27. When the flooring elements 20 are forced from a slanting angle, it may not be hindered by excessive deep grooves or excessively high projections. The auxiliary grooves 16 and auxiliary blocks 16 may have a step-like flexible size so that the flooring elements 20 may be smoothly forced in. The width thereof is also slightly smaller so as to form a flexible clearance H to facilitate forcing in or removal.

2. Good positioning:

Referring to FIG. 4 again, the engagement is configured to be achieved by means of the vertical surface E and the inclined surface F. The vertical surface F may enhance the urging force, while the inclined surface F may enable hooking to prevent the flooring materials from deformation. Therefore, the engagement according to the present invention is achieved not by using two inclined surfaces to enhance the positioning effects at both sides. Besides, as the flooring elements 20 may be forced in from the sides, and not by means of the inclined surfaces which require linear slidable insertion (which creates the problem of more work space), the flooring assembly is easier to assemble.

After the foundation elements 10 and the flooring elements 20 are properly connected together, the decorative strip seats 30 along with tap screws 34 are nailed to the flooring elements 20 at the rims. The inclined elastic pieces 35 of the decorative strip seats 30 are forced to run in a straight line according to the wall surface. Resilience will evidently result therefrom, achieving the effects of preventing the loosening of the tap screws 34 (they will not become loosened since there is an urging force), helping the flooring elements 20 to urge against the wall surface due to the decorative strip seats 30, and maintaining no clearance between the wall surface and the flooring assembly. Finally, the decorative strips 40 are coupled to the decorative strip seats 30 by means of the grooves 41, 42 corresponding to the projected strips 31, 32. the curved grooves 43 and curved flanges 33 are arranged to prevent dislocation of the decorative strips 40. From the above, it can be seen that the present invention does not require any tools except for the tap screws 34 and some cutting work. The flooring assembly of the invention is therefore easy, speedy and convenient to assemble, without the need for professional workers.

Figure 8:
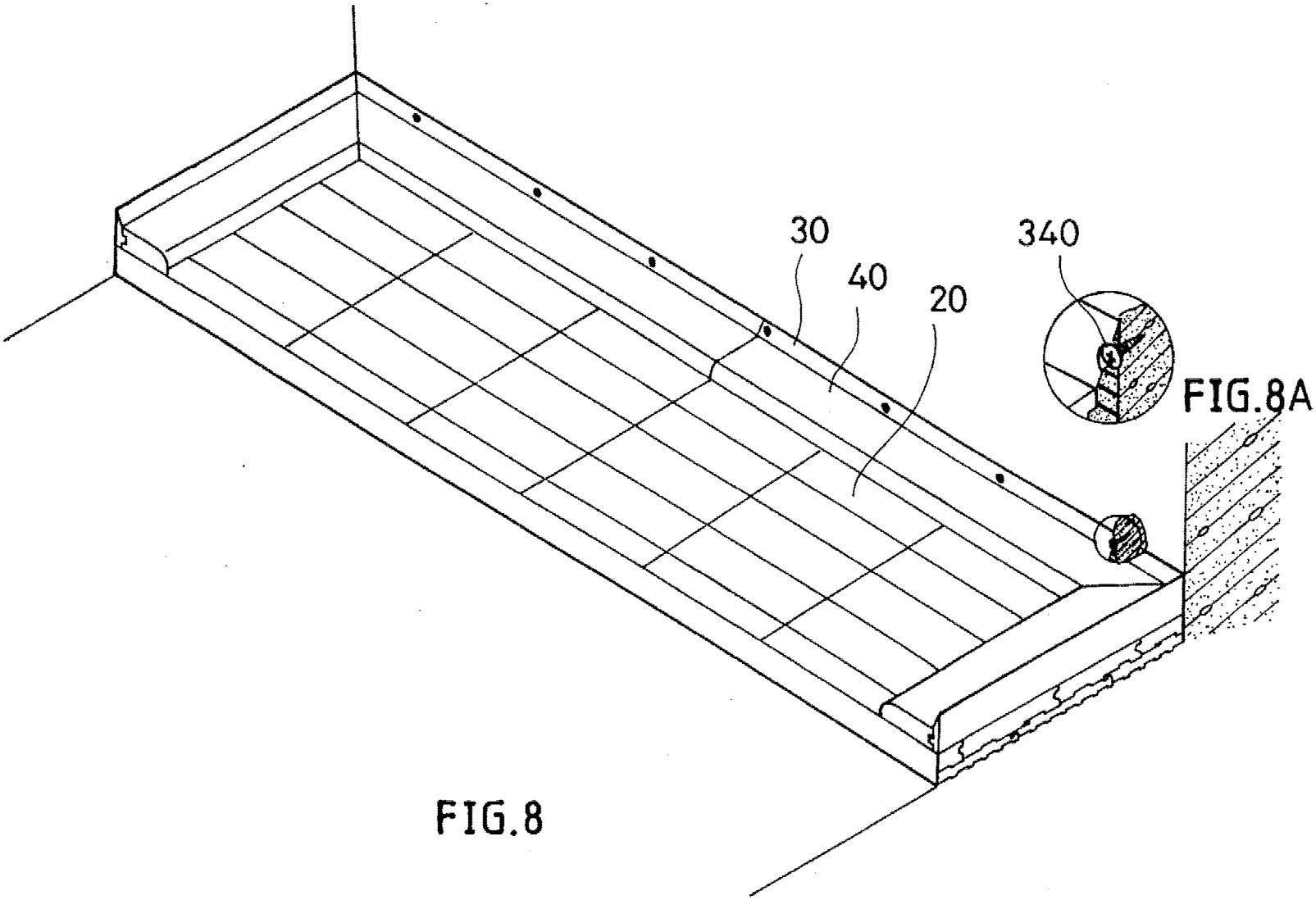
FIG. 8 is an outer view of the flooring assembly of the invention used to cover only a portion of the floor of the room.
Figures 9, 9A:
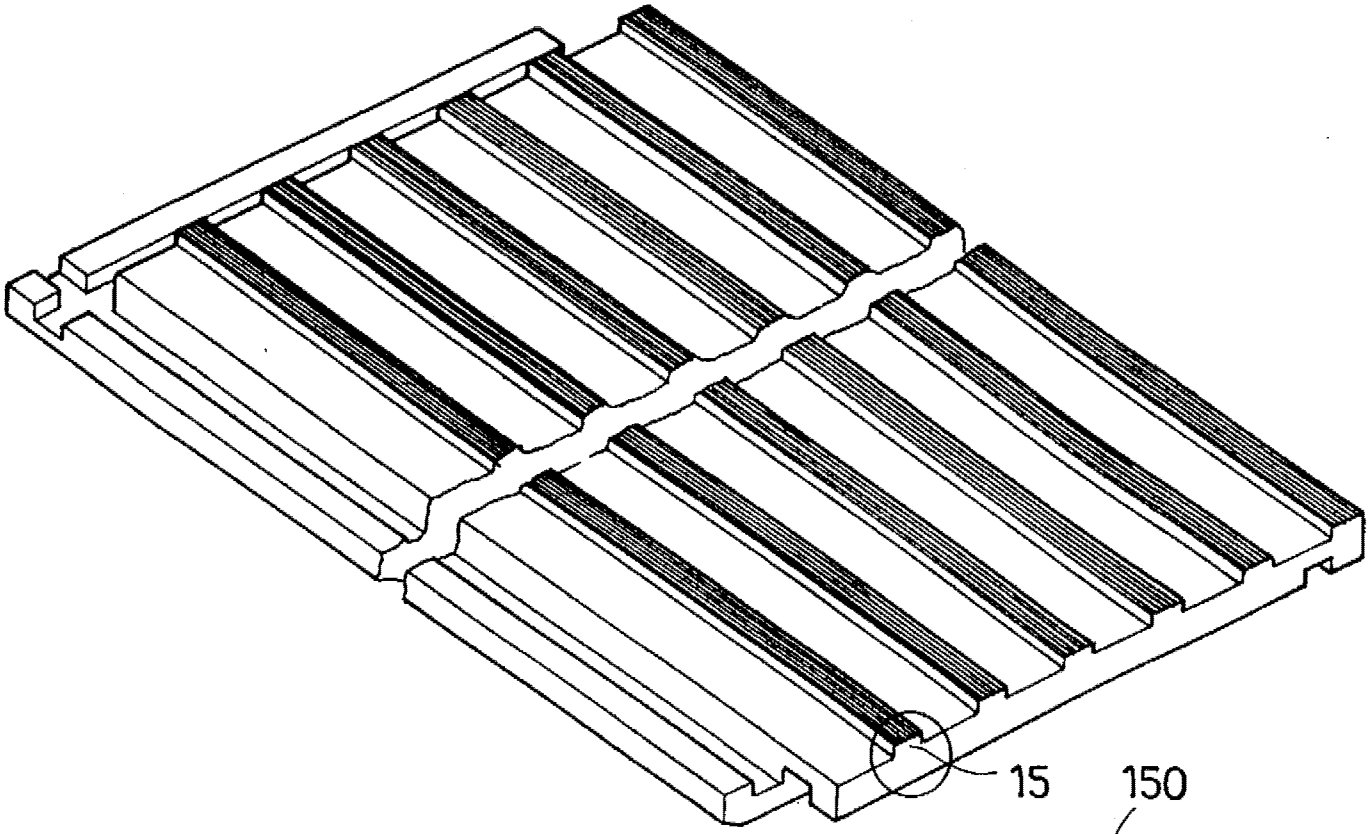
FIG. 9 illustrates the flooring element with non-skid strips.
Figure 10:
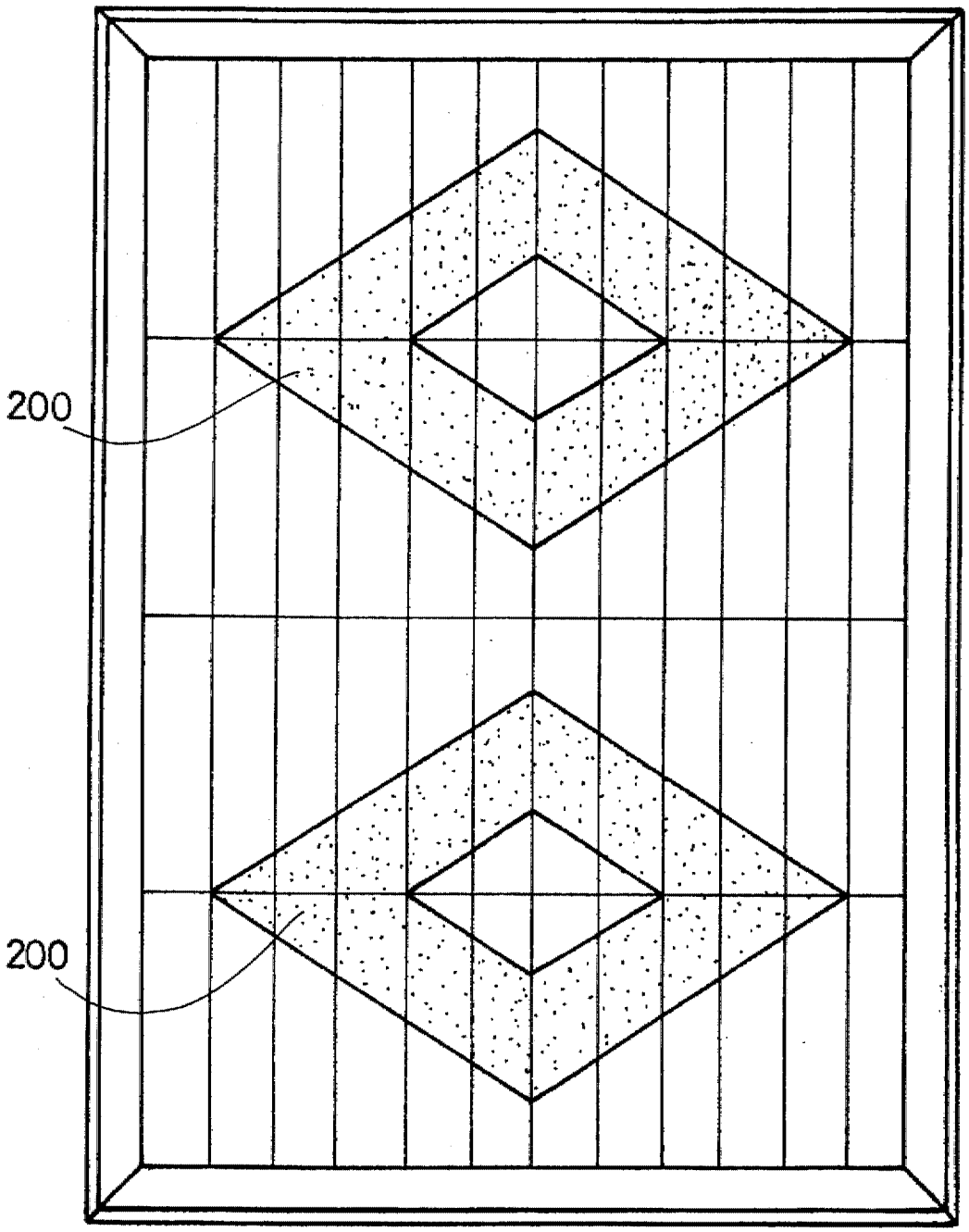
FIG. 10 a schematic top view of the flooring assembly with patterns.

The present invention further has the following advantages in terms of its use and effects:

1. The non-skid strips 15 on the foundation elements 10 may prevent skidding. If the flooring assembly is used to cover the entire room the size thereof will just fit the room so that there is no problem of skidding. But if the flooring assembly is used to cover only a part of the room, the surface of the non-skid strips 15 may be provided with non-skid patterns 150 as shown in FIG. 9, and the decorative strip seat 30 at the rear side may be nailed to the wall by nails 340 (as shown in FIG. 8).
2. The foundation elements 10 are made of plastic which will not absorb dampness. Besides, there are provided clearances 18 for isolating the dampness rising from the floor. The flooring elements 20 may thus be unaffected by the dampness of the floor.
3. As shown in FIG. 10, flooring elements 200 of different colors and patterns may be selected and cut into desired shapes. They may fit together just like blocks to provide variety.
4. The present invention may be adapted for use in stone flooring materials. Generally, stone flooring materials are laid on the floor using cement and sand. So long as the bottom sides of the stone flooring materials are provided with the structure of the invention, they may be assembled in the same way, without the need to use cement or sand.
5. As the foundation elements and the flooring elements are tightly joined to increase their thickness, when people walk on the flooring assembly, there will be very little noise compared to the prior art in which noise is generated due to hollowness. The flooring assembly of the invention provides a solid feel.

In summary, the present invention is a breakthrough in the art in terms of the modes and effects. The flooring assembly of the invention may be assembled and dismantled with ease and is not costly.

Although the present invention has been illustrated and described with reference to the preferred embodiment thereof, it should be understood that it is in no way limited to the details of such embodiment but is capable of numerous modifications within the scope of the appended claims.

What is claimed is:

1. An improved flooring assembly comprising a required number of foundation elements, flooring elements, decorative strip seats and decorative strips, all of which being cut into desired lengths and widths, and a front side of each foundation element and a rear side of each flooring element being provided with corresponding face grooves and face projections; wherein said foundation elements each have one side of a joint between said face groove and said face projection forming a vertical surface while the other side thereof forming an inclined surface, and a slightly raised auxiliary groove being provided at the joint; a bottom side of each of said foundation elements being distributed with a plurality of non-skid strips to define dampness blocking clearances, one side of the front side of each of said foundation elements being provided with a linear groove and a side groove to form a linear strip and a side strip respectively, and the opposite side of the other side of the front side being provided with a linear groove and a side groove for forming a linear strip and a side strip respectively, so that various foundation elements may inter-engage by means of said linear grooves and strips as well as said side grooves and strips to expand the flooring area to both sides as well as to the front and the back;

said flooring elements each have one side of a joint between said face groove and face projection forming a vertical surface while the other side thereof forming an inclined surface, a slightly lower auxiliary block being provided at the joint as well; the periphery of each of said flooring elements being provided with corresponding positioning grooves and positioning blocks so that various flooring elements may inter-engage to expand the flooring area to both sides as well as to the front and the back;

said decorative strip seats are substantially L-shaped and are secured to rims of the flooring elements by means of tap screws, one side of each of said decorative seats being provided with a vertically oriented projected strip with the other side thereof being provided with a horizontally oriented projected strip and an inclined elastic piece; and said decorative strips are also substantially L-shaped for matching said decorative strip seats, said decorative strips having grooves for matching said projected strips of said decorative strip seats so that said decorative strips may couple to said decorative strip seats as an integral whole;

thereby said foundation elements, said flooring elements, said decorative strip seats and said decorative strips may be assembled easily and speedily according to the floor area of a room and may be dismantled.

2. An improved flooring assembly as claimed in claim 1, wherein said decorative strip seats and said decorative strips are provided with corresponding curve flanges and curved grooves to enhance the connection therebetween.

3. An improved flooring assembly as claimed in claim 1, wherein said non-skid strips on said foundation elements are configured to non-skid patterns.

4. An improved flooring assembly as claimed in claim 1, wherein said inclined elastic piece of each of said decorative strip seats is in a planar form when assembled to a wall so as to generate a resilient force to prevent said tap screws from loosening and preventing any clearances between the flooring assembly and the wall.

5. An improved flooring assembly as claimed in claim 1, wherein said foundation elements are preferably made of plastic material and are tightly attached to said flooring elements so as to effectively block dampness from the floor surface and reduce noise.

* * * * *